United States Patent [19]

Yamamoto

[11] Patent Number: 4,574,785

[45] Date of Patent: Mar. 11, 1986

[54] DEVICE FOR CONTROLLING THE RAISING AND LOWERING MOVEMENT OF A FLUIDIZED BED

[75] Inventor: Hitoshi Yamamoto, Kanagawa, Japan

[73] Assignee: Fuji Electric Company Ltd., Japan

[21] Appl. No.: 614,940

[22] Filed: May 29, 1984

[30] Foreign Application Priority Data

May 27, 1983 [JP] Japan ..... 58-93763

[51] Int. Cl.[4] ..... A47C 27/08

[52] U.S. Cl. ..... 128/24 R; 5/453; 128/53; 137/624.11

[58] Field of Search ..... 128/24, 51–53; 137/624.11; 5/453, 449, 450

[56] References Cited

U.S. PATENT DOCUMENTS

| | | | |
|---|---|---|---|
| 3,667,073 | 6/1972 | Renfroe | 128/24 R |
| 4,214,576 | 7/1980 | Henley | 128/24.1 |
| 4,431,182 | 2/1984 | Reynolds | 5/453 |
| 4,466,459 | 8/1984 | Higgins | 137/624.11 |
| 4,483,029 | 11/1984 | Paul | 128/33 |

FOREIGN PATENT DOCUMENTS

| | | | |
|---|---|---|---|
| 2806239 | 8/1979 | Fed. Rep. of Germany | 137/624.11 |

*Primary Examiner*—Clyde I. Coughenour

*Attorney, Agent, or Firm*—Sughrue, Mion, Zinn, Macpeak, and Seas

[57] ABSTRACT

A device for controlling the raising and lowering of a fluidized bed for supporting a human body on a bed of particles which can be made to float and flow by supplying air under pressure thereto. A drive unit vertically raises or lowers the bed in response to a vertical movement command issued by a control unit. A flow stop command is issued for stopping the operation of an air compressor, which floats the beads, when the vertical movement command is generated. The vertical movement command is inhibited during a predetermined interval after the command has been generated in order for the flow of compressed air to stop to allow the beads to come to rest before the bed is raised or lowered.

4 Claims, 6 Drawing Figures

DEVICE FOR CONTROLLING THE RAISING AND LOWERING MOVEMENT OF A FLUIDIZED BED

BACKGROUND OF THE INVENTION

The present invention relates to a device for controlling the operations of a medical fluidized bed for floating and supporting a human body, for purposes of medical treatment, on a bed of fine particles subjected to a flowing movement induced by a stream of compressed air diffused upwardly through a diffuser board.

Fluidized beds of the type described have principally been used in the medical field. The construction and operation of a fluidized bed will be described with reference to FIG. 1A. Ambient air AO is compressed and fed by a ring compressor 1 driven by a motor 1*a*, which has an increased temperature, is cooled to a prescribed temperature by a heat exchanger HC supplied with air from a fan F. Compressed air A1 directed via an air duct D is spread below a diffuser board 3 in a closed chamber 2.

The diffuser board 3, which is formed of a porous plate-like material, is provided for diffusing and spreading the compressed air A1 in the closed chamber 2 as diffused air moving upwardly through a multiplicity of gaps or interstices in the diffuser board 2 which are present throughout the entire area thereof. A bed 5 of fine particles or beads is subjected to a flowing movement by the diffused air 5. A tank 4 integral with the closed chamber 2 contains the bead bed 5 and the diffuser board 3. The upper surface of the bed 5 is covered with a sheet of cloth S having interstices smaller than the beads for allowing the diffused air A2 to pass therethrough while preventing the beads 5 from being dispersed. The sheet S also serves as a sheet of gauze or a bandage in contact with the patient resting thereon.

The fluidized bed is capable of preventing the interruption of blood circulation due to localized pressure exerted on the patient's body. Therefore, the bed has heretofore been used mainly for promoting the regrowth of skin of a badly burned patient or preventing bedsores in a patient bedridden for a long time. When the patient lies on the bed of flowing beads 5 with the sheet S interposed, the patient is supported evenly by the beads which undergo flowing movement below a wide area of the patient body. As a result, the surface pressure on the body is minimized, reducing pressure on the skin. Since the surface pressure is uniformly distributed, interruption of blood circulation due to localized pressure on peripheral blood vessels is avoided.

FIG. 1B illustrates the manner in which a human body is floatingly supported on the fluidized bed.

The conventional fluidized bed has a fixed height. However, there has been a demand for a fluidized bed having an adjustable height, specifically, one in which the height of the bed above the floor can be made as small as possible for ease in transferring a patient onto the bed or when a patient gets onto or off the bed, and placed at a suitable height when the patient is lying on the bed for administering treatment to the patient.

To meet this demand, it has been proposed to combine a lifter with the bed for adjusting the height of the bed. FIG. 2 illustrates the arrangement of such a mechanism for producing vertical movement.

The height of the fluidized bed, and hence the height of the tank 4, are freely adjustable by a lifter LF between a maximum height H1 and a minimum height H2. The lifter LF includes a link mechanism LK having bearings P1 and P2 fixed to ends thereof and rollers R1 and R2 on opposite ends thereof which are movable along a guide rail. A hydraulic cylinder OS serves as a vertical drive unit for extending and retracting the link mechanism LK. Vertical movement of such a vertically movable fluidized bed with a patient thereon while the beads 5 are in a flowing condition, however, results in the danger of causing the patient to move unnecessarily on the bed.

SUMMARY OF THE INVENTION

It is accordingly an object of the present invention to provide a device for controlling the raising and lowering movement of a fluidized bed and which is capable of interlocking or preventing flowing movement of the beads while the bed is being vertically moved to thereby eliminating the danger mentioned above.

In accordance with the present invention, when the bed is being moved upwardly or downwardly, the flowing movement of beads is temporarily stopped to put the patient's body at rest in a manner as if confined in a sand mold. After the movement of the head has been completed, the beads are allowed to flow again.

DESCRIPTION OF THE PREFERRED EMBODIMENTS

Figure 1A:
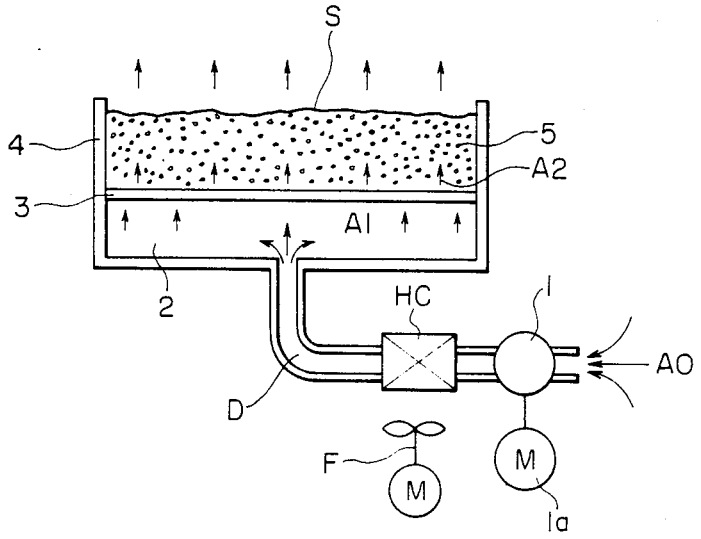
FIG. 1A PRIOR ART
FIGS. 1A and 1B are views showing a conventional fluidized bed.
Figure 1B:
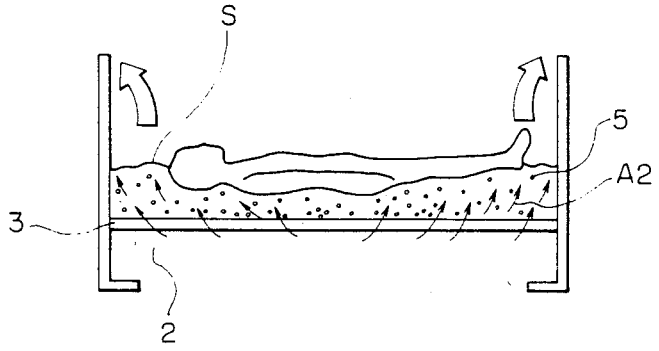
FIG. 1B PRIOR ART

Preferred embodiments of the present invention will be described with reference to FIGS. 3 and 4. Like reference characters or numerals denote identical or corresponding parts throughout. In the following description, "H" is used to mean a logic "high" level and "L" a logic "low" level.

Figure 3:
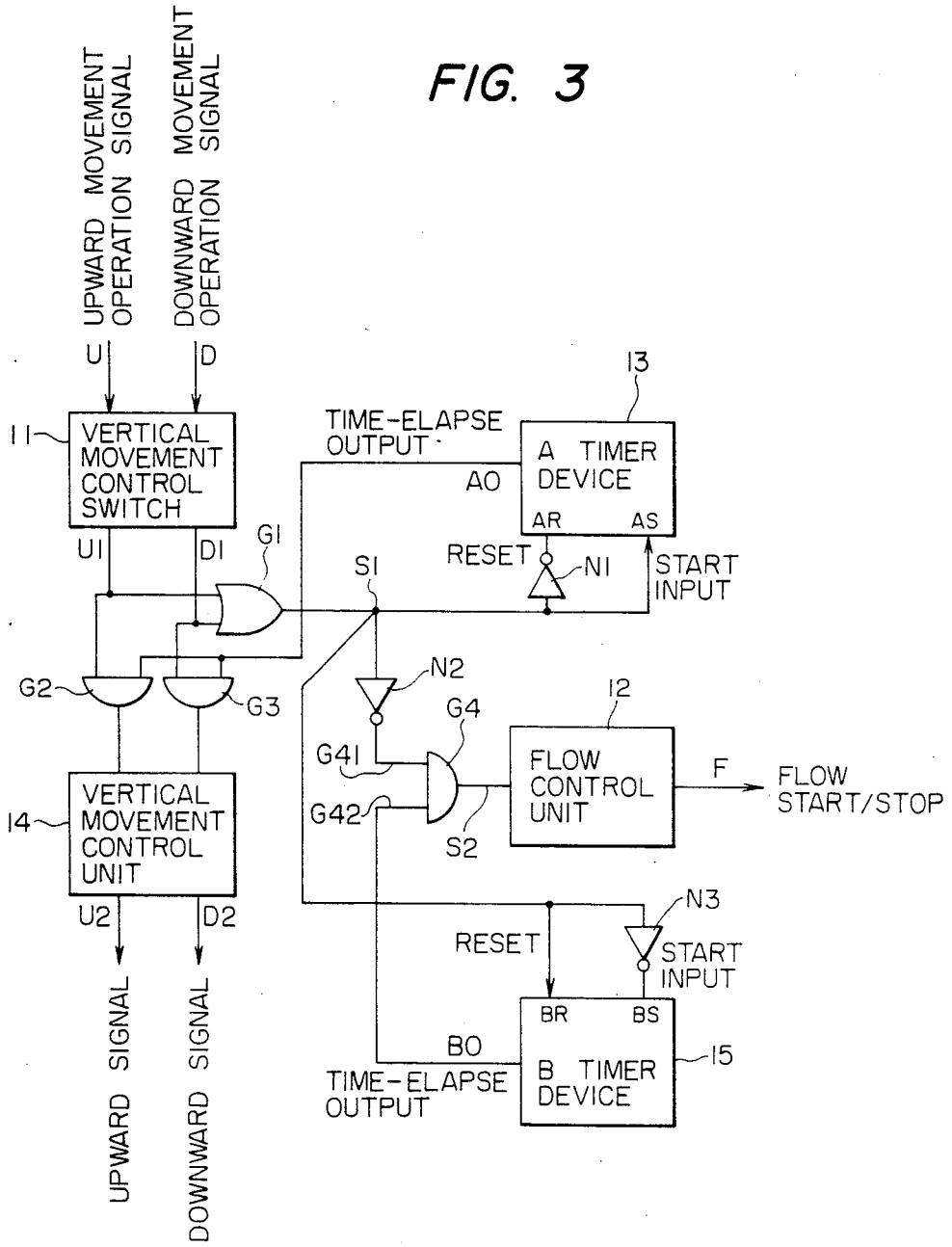
FIG. 3 is a block diagram of a control device according to the present invention.
Figure 4:
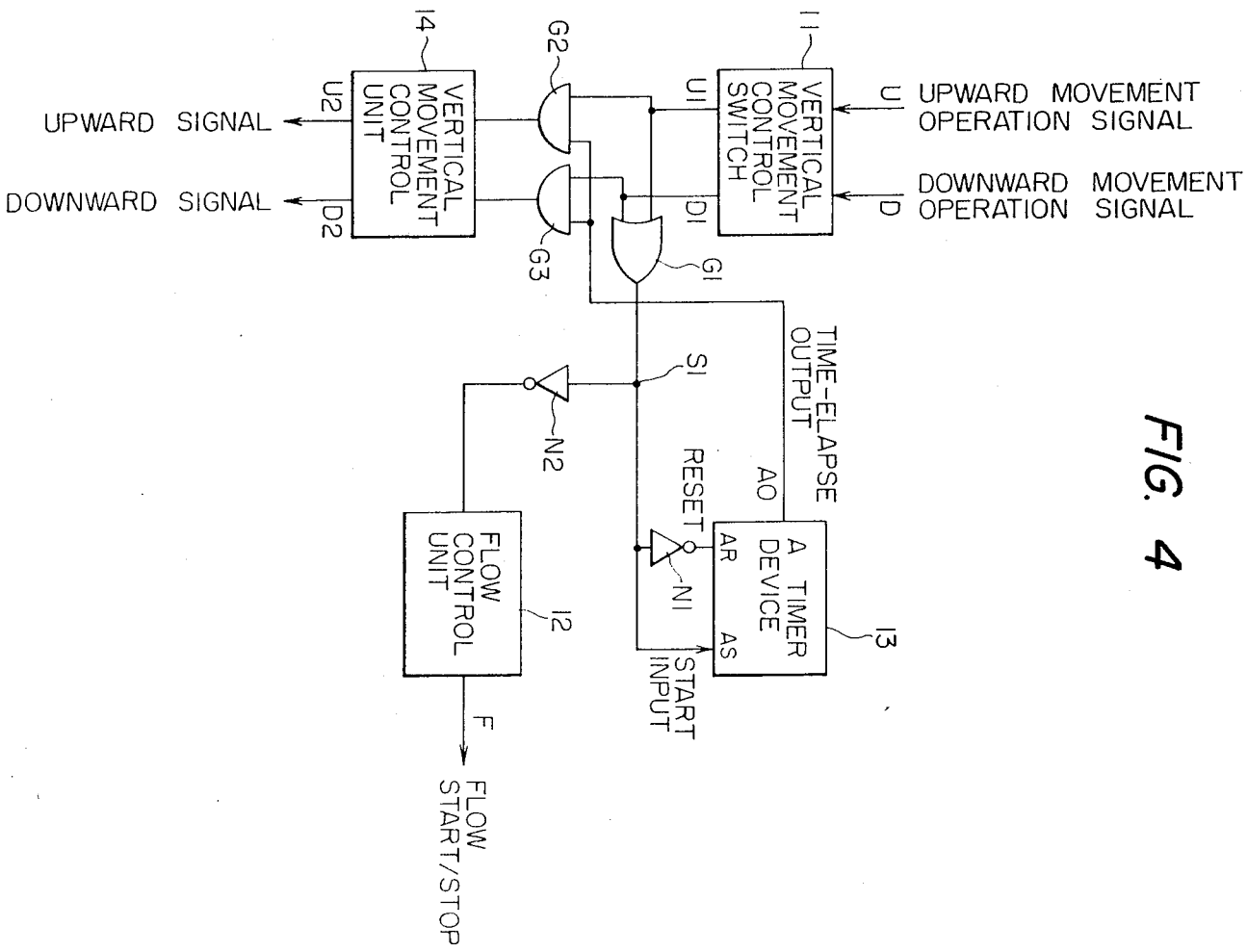
FIG. 4 is a block diagram of a control device constructed according to another embodiment of the present invention.

As shown in FIG. 3, a vertical movement control switch 11 is responsive to a manual upward control operation signal U or a manual downward control operation signal D for issuing an upward control signal U1 or a downward control signal D1. The vertical movement control switch 11 is a manually operated pushbutton switch in the illustrated embodiment. A flow control unit 12 generates a flow start/stop signal F serving as an ON/OFF signal for the blower motor 1*a* (FIG. 1A) dependent on the level (H or L) of an output signal S2 from an AND gate G4. A timer device 13 provides a first delay time after the signal F has become a flow stop command, extending at least until the flowing movement of the beads 5 stops. The timer device 13, which is started simultaneously with the issuance of the upward control signal U1 or the downward control signal D1, applies a time-elapse signal AO at the L level to AND gates G2 and G3 to block the upward control signal U1 or the downward control signal D1. Upon elapse of the first delay time, the time-elapse signal AO goes to the H level, opening the AND gates G2 and G3.

Figure 2A:
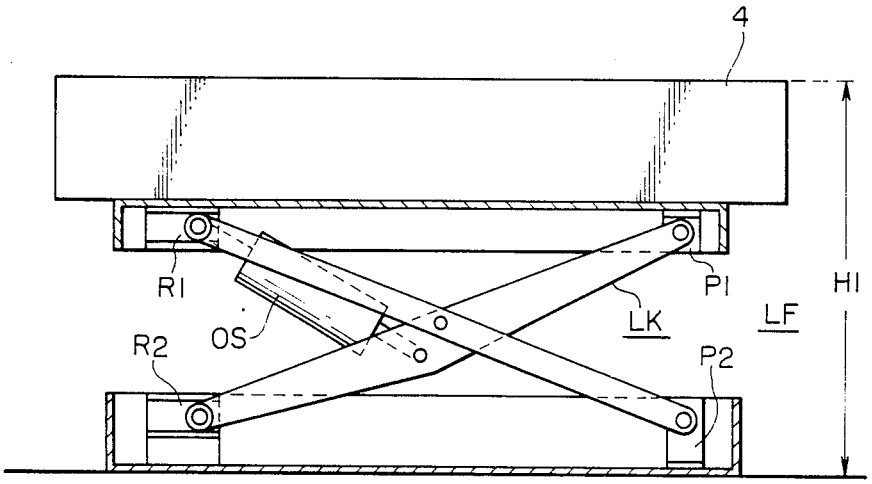
FIGS. 2A and 2B are views illustrating a mechanism for vertically moving a fluidized bed according to the present invention.
Figure 2B:
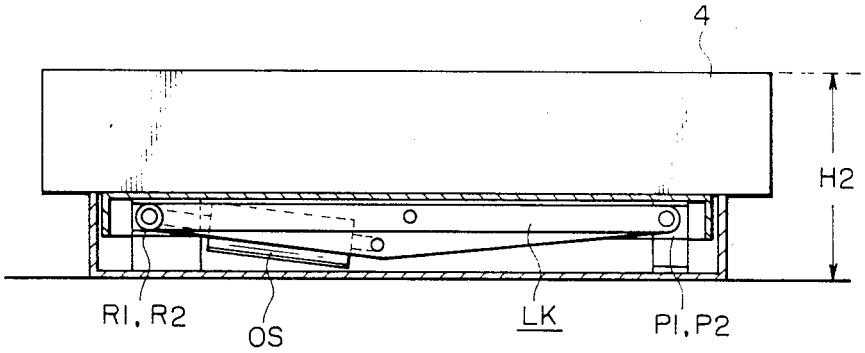

A vertical movement control unit 14, in response to an output from either of the AND gates G2 and G3, applies an upward signal U2 or a downward signal D2 as an ON signal to an upward-control solenoid-operated valve or a downward-control solenoid operated valve (not shown) which supplies oil to the hydraulic cylinder OS (FIG. 2) for raising or lowering the lifter LF. A second timer device 15 provides a second delay time commencing following the upward signal U2 or the downward signal D2 changing to the L state, lasting at least until a locking operation of a safety lock mechanism (not shown) for fixing the stroke of the hydraulic cylinder is completed. The operation of the timer device 15 is started simultaneously with the change of the upward signal U2 or the downward signal D2 to the L state for applying a time-elapse signal BO at the L level to a terminal G42 of the AND gate G4 to close the gate G4 and thus prevent the beads 5 from starting their flowing movement. Upon the elapse of the second delay time, the time-elapse signal BO goes to the H level, opening the AND gate G4. Designated by G1 is an OR gate, and by N1, N2 and N3 inverters.

The operation of the control system illustrated in FIG. 3 will be described. When an upward control operation or downward control operation is manually effected by operation of the vertical movement control switch 11, the manual pushbutton switch 11 continuously issues an H-level upward control signal U1 or a downward control signal D1 as long as the switch 11 is depressed. The OR gate G1 then produces an H-level output signal S1, which is converted by the inverter N2 to an L-level signal that is applied to the other terminal G41 of the AND gate G4. Since the time-elapse signal BO from the B timer device 15 applied to the other terminal G42 of the AND gate G4 is at the H level, the flow of compressed air to the bed of beads is stopped. The H-level output signal S1 is applied via the inverter N1 as an L-level reset signal to a reset terminal AR of the timer device 13, and also as a start signal to a start terminal AS of the timer device 13, whereupon the timer device 13 starts its timing operation to produce an L-level time-elapse signal AO. The L-level time-elapse signal AO is applied to the AND gates G2 and G3 to prevent the upward control signal U1 or the downward control signal D1 from being applied to the vertical movement control unit 14. Therefore, neither the upward signal U2 nor the downward signal D2 is issued from the upward movement control unit 14 to the vertical drive mechanism for the fluidized bed, that is, to the solenoid-operated valves which supply hydraulic fluid to actuate the piston of the hydraulic cylinder OS shown in FIG. 2.

The H-level output signal S1 is applied to the timer 15 as a signal of a logic level opposite that of the signals applied to the timer device 13. More specifically, an H-level reset signal is applied to a reset terminal BR, while an L-level signal is applied via the inverter N3 to a start terminal BS. Therefore, the time-elapse signal BO remains at the H level.

When the first delay time set by the time device 13 has elapsed, the time-elapse signal AO changes to the H level, opening the AND gates G2 and G3. The H-level upward control signal U1 or the downward control signal D1 is then fed to the upward movement control unit 14, which in response issues the upward signal U2 or the downward signal D2 to the solenoid-operated valve to lift or lower the fluidized bed.

The beads remain at rest for the time period between the instant the timer 13 starts its operation until the delay time set thereby has elapsed. The patient is fixed in the beads and thus held at rest.

When the upward control operation or the downward control operation ceases after the bed has reached a desired height, the upward control signal U1 or the downward control signal D1 changes to the L level to thereby eliminate the upward signal U2 or the downward signal D2 from the vertical movement control unit 14, whereupon the vertical movement of the bed is stopped. The output signal S1 from the OR gate G1 then changes to the L level to reset the timer device 13. The time-elapse signal AO remains at the H level.

The L-level output signal S1 is converted by the inverter N2 into an H-level signal, which is applied to the input terminal G41 of the AND gate G4. The output signal S1 in the L level is also applied as a reset signal to the reset terminal BR of the timer device 15 and as a H-level start signal to the start terminal BS thereof. The time-elapse signal BO then changes to the L level, which level is applied to the terminal G42 of the AND gate G4. The output signal S2 from the AND gate G4 remains at the L level so that the signal F continues to act as a flow stop command.

Upon the elapse of the second delay time set by the timer device 15, the time-elapse signal BO changes to the H level and the output signal S2 from the AND gate G4 also changes to the H level. The flow control unit 12 changes the signal F to a flow start command for thereby restarting the flowing movement of the beads.

During the operation of the timer device 15, the safety lock mechanism for fixing the stroke of the hydraulic cylinder OS is actuated to lock the hydraulic cylinder. However, the timer device 15 may be dispensed with if the arrangement of the vertical drive mechanism permits. FIG. 4 illustrates another embodiment of the present invention in which the second timer device 15 is dispensed with, and an output signal from the inverter N2 is directly applied to the flow control unit 12.

In the above-described embodiments, the time after a signal indicative of the time required for stopping the flowing movement of the beads is indirectly established by the timer device 13. However, direct control such as by the use of a detector which detects the pressure of the compressed air A1 or the flowing movement of the beads 5 may be used instead.

With the present invention, as is apparent from the above description, the beads are reliably prevented from flowing prior to any attempted vertical movement of the bed. The bed can be lifted or lowered only after the patient has been confined and fixed in the "sand mold" of the beads held at rest. As a consequence, the bed can be adjusted in height with safety and without endangering the patient.

I claim:

1. A device for controlling the raising and lowering of a fluidized bed for supporting a human body on a bed of particles floating and flowing with air under pressure, comprising:

a drive unit for vertically raising and lowering the bed;

control means for issuing a vertical movement command to said drive unit;

vertical movement control means for controlling operations of said drive unit in response to the vertical movement command from said control means;

flow control means for controlling flowing movement of air in said bed;

means for issuing a flow stop command to said flow control means when said vertical movement command is generated by said control means and for issuing a flow start command to said flow control means when generation of said vertical movement command is stopped; and means for inhibiting the vertical movement command applied from said control means to said vertical movement control means during a predetermined interval of time after the vertical movement command has been generated until said bed of particles stops its flowing movement.

2. The device for controlling the raising and lowering of a fluidized bed of claim 1, wherein said inhibiting means comprises a first timer having as a trigger input said vertical movement command.

3. The device for controlling the raising and lowering of a fluidized bed of claim 2, further comprising a second timer, said second timer being triggered at an end of said vertical movement command, an output of said second timer being applied to inhibit said means for issuing a flow stop command during a second predetermined interval of time after the end of said vertical movement command.

4. The device for controlling the raising and lowering of a fluidized bed of claim 3, further comprising an AND gate having an output connected to a control input of said means for issuing a flow stop command, a first input coupled to an output of said second timer, and a second input receiving said vertical movement command inverted.

* * * * *